US006990775B2

(12) United States Patent
Koester

(10) Patent No.: US 6,990,775 B2
(45) Date of Patent: Jan. 31, 2006

(54) MOISTURE DRAINAGE PRODUCT, WALL SYSTEM INCORPORATING SUCH PRODUCT AND METHOD THEREFORE

(75) Inventor: John H. Koester, St. Michael, MN (US)

(73) Assignee: Masonry Technology, Inc., Cresco, IA (US)

( * ) Notice: Subject to any disclaimer, the term of this patent is extended or adjusted under 35 U.S.C. 154(b) by 0 days.

(21) Appl. No.: 10/464,063

(22) Filed: Jun. 18, 2003

(65) Prior Publication Data

US 2004/0255533 A1 Dec. 23, 2004

(51) Int. Cl.
*E04F 17/00* (2006.01)
*E04F 17/04* (2006.01)

(52) U.S. Cl. ..... 52/302.1; 52/352; 52/783.11; 52/783.17; 52/783.19; 52/798.1; 52/302.3; 52/302.6; 428/182; 428/121

(58) Field of Classification Search ..... 52/302.1, 52/352, 745.9, 347–350, 354–356, 344, 783.1, 52/783.11, 783.17, 783.19, 784.12, 784.13, 52/798.1, 792.11; 428/181–183, 138, 192, 428/121–130, 76–77, 68, 74
See application file for complete search history.

(56) References Cited

U.S. PATENT DOCUMENTS

| | | | | | |
|---|---|---|---|---|---|
| 1,444,709 | A * | 2/1923 | Sea | 52/328 |
| 2,264,961 | A | 12/1941 | Ward | 20/4 |
| 2,609,956 | A * | 9/1952 | Stevenson | 217/42 |
| 3,318,056 | A | 5/1967 | Thompson | 52/105 |
| 3,498,015 | A * | 3/1970 | Green et al. | 52/310 |
| 3,654,765 | A | 4/1972 | Healy et al. | 61/11 |
| 3,888,087 | A | 6/1975 | Bergsland | 61/11 |
| 4,114,335 | A * | 9/1978 | Carroll | 52/336 |
| 4,189,886 | A * | 2/1980 | Frohlich et al. | 52/302.1 |
| 4,381,630 | A | 5/1983 | Koester | 52/169.5 |
| 4,507,348 | A * | 3/1985 | Nagata et al. | 428/172 |
| 4,507,901 | A * | 4/1985 | Carroll | 52/302.3 |
| 4,745,716 | A | 5/1988 | Kuypers | 52/169.5 |
| 5,598,673 | A | 2/1997 | Atkins | 52/302.1 |
| 5,692,348 | A | 12/1997 | Ambrosino | 52/169.5 |
| 5,713,696 | A | 2/1998 | Horvath et al. | 405/45 |
| 5,826,390 | A | 10/1998 | Sacks | 52/408 |
| 6,298,620 | B1 | 10/2001 | Hatzinikolas | 52/302.1 |
| 6,355,333 | B1 * | 3/2002 | Waggoner et al. | 428/174 |
| 6,410,118 | B1 * | 6/2002 | Reicherts et al. | 428/141 |
| 2002/0108333 | A1 | 8/2002 | Clayton | 52/302.1 |

* cited by examiner

*Primary Examiner*—Jeanette E. Chapman
(74) *Attorney, Agent, or Firm*—IPLM Group, P.A.

(57) ABSTRACT

A product, and a wall system utilizing such product, adapted to allow drainage of moisture from a wall of a structure. A sheet of corrugated material forms a plurality of ridges and grooves on opposite sides of the sheet of corrugated material. The sheet of corrugated material is relatively inflexible under a force applied generally perpendicular to the sheet. The sheet of corrugated material has a multiplicity of perforations. A sheet of water permeable material is affixed to one side of the sheet of corrugated material. The product is flexible in a direction along the plurality of ridges and grooves allowing the product to be stocked in roll form. A method of providing drainage of moisture from a wall structure is also disclosed.

8 Claims, 6 Drawing Sheets

MOISTURE DRAINAGE PRODUCT, WALL SYSTEM INCORPORATING SUCH PRODUCT AND METHOD THEREFORE

TECHNICAL FIELD

This invention relates to moisture drainage products and, more particularly, to moisture drainage products intended for incorporation in wall systems and methods for providing moisture drainage in wall systems.

BACKGROUND

Warm, moisture-laden air can exist in buildings even in buildings in colder climates. A significant amount of moisture can be placed into the air through common household activities, such as cooking, bathing and showering.

Especially in colder climates, insulation in a wall structure helps to reduce heat loss from buildings which are heated due to the cold climate. As moisture-laden air passes through the wall structure of such buildings, the moisture-laden air encounters steadily decreasing temperatures. As the air is cooled while moving from the interior of a wall structure to the exterior of the wall structure, the air can eventually reach its dew point and water vapor in the air condenses to form moisture. The result can be a moisture buildup in the wall structure.

Vapor barriers are commonly employed on the warm side of wall structures in order to prevent moisture-laden air from entering the wall structure. However, vapor barriers are not usually perfect. In a typical building, multiple penetrations of a vapor barrier can occur, e.g., from electrical and plumbing lines and from windows and doors.

If the exterior temperature is cold enough, the moisture existing in the wall structure could eventually turn to frost or ice and, thus, be prevented from draining from the wall structure, at least until the exterior temperature increases. When that happens, however, the moisture can still cause significant damage to the wall structure.

Several products exist to allow drainage of moisture from wall structures once the moisture has formed in the wall structure.

U.S. Pat. No. 3,654,765, Healy et al, Subterranean Wall Drain, discloses a subterranean wall drain unit including a drain pipe having openings therein and a longitudinally extending planar core defining channels normal to the pipe. A water pervious sheet material covers one face of the core and the openings in the pipe to form a filter therefore. The other face of the core may be covered with a plastic sheet or other vapor barrier.

U.S. Pat. No. 3,888,087, Bergsland, Foundation Wall Protective Sheet, discloses improvements in protective membranes or sheets for foundation walls. The sheets have regular courses of protrusions for spacing the sheet from the foundation wall and a porous backing for drainage outwardly of the sheet. The protrusions provide air channels between the protective sheet and the foundation for thermal insulation and for facilitating drying of the foundation wall. Small vertical ribs between the courses of the protrusions provide convenient water passages to take care of drainage water in the porous backing without interfering with the air spaces and incidentally providing bending vertical lines for more facile installation handling. Modifications of the sheet include transverse ribs at lower portions of the sheet to allow horizontal bending thereof wall for footing and drainage configurations. A barrier for preventing back fill falling between the protective sheathing and foundation is also disclosed.

U.S. Pat. No. 3,318,056, Thompson, Ventilating Wall Construction With Stud Location Indicators, discloses a sheet of building material placed between wall veneers for moisture protection that includes vertical drainage channels and perforations.

U.S. Pat. No. 6,298,620, Hatzinilolas, Moisture Control Panel, discloses a moisture control panel used in exterior walls. A wall constructed with the panel has an inner back-up wall component and an outer wall component of a moisture pervious material, for example, stucco. The moisture control panel is positioned between the two. It has a base sheet on the inner face of the outer wall component. A set of drying perforations slope downwardly toward the inside through this sheet. This drains moisture from the inside of the outer wall component. On the inside, the bay sheet has a set of upwardly sloping bosses which provide an air space on the inside the moisture control panel providing for air circulation and drainage of any moisture.

U.S. Pat. No. 4,381,630, Koester, Foundation Vent Structure, discloses a foundation vent structure positioned upon the footings of the building below the lowermost row of concrete blocks of the basement wall and extends below the concrete floor of the basement. The vent structure is formed of a plastic material, preferably in strips, and is shaped to define alternate tunnels and channels having openings therein. The vent structure intercommunicates the openings in the hollow, concrete blocks with the drain area located along the marginal area below the basement wall to permit moisture to be vented into this drain area.

However, significant problems exist with such pre-existing products and systems. Such products can prevent the continued movement of moisture of water vapor from the interior to the exterior side of the wall structure where the moisture or water vapor then exits the wall structure and, hence, can cause no further damage. Such products can also become contaminated with other construction materials being used in the formulation of the wall structure or otherwise in the construction of the building.

SUMMARY OF THE INVENTION

The present invention helps prevent damage from moisture in a wall structure by draining such moisture from the wall structure using ridges and grooves to form vertical channels which allow such moisture to drain. The present invention also allows water vapor and moisture to pass through the product allowing such water vapor or moisture to continue its passage from the interior of the wall structure to the exterior of the building. And further, the present invention prevents other construction materials from contaminating the channels formed by the ridges and grooves permitting moisture to drain in the existing channels.

The present invention provides a product adapted to allow drainage of moisture from a wall of a structure. A sheet of corrugated material forms a plurality of ridges and grooves on opposite sides of the sheet of corrugated material. The sheet of corrugated material is relatively inflexible under a force applied generally perpendicular to the sheet. The sheet of corrugated material has a multiplicity of perforations. A sheet of water permeable material is affixed to one side of the sheet of corrugated material. The product is flexible in a direction along the plurality of ridges and grooves allowing the product to be stocked in roll form.

In an alternative embodiment, the present invention also provides a wall system for a structure having an interior and an exterior. A plurality of structural members form a structural support for the wall system. Sheathing is placed exterior of the plurality of structural members. A moisture drainage product adapted to allow drainage of moisture from the wall system has a sheet of corrugated material forming a plurality of ridges and grooves on opposite sides of the sheet of corrugated material. The sheet of corrugated material is relatively inflexible under a force applied generally perpendicular to the sheet. The sheet of corrugated material has a multiplicity of perforations. A sheet of water permeable material is affixed to one side of the sheet of corrugated material. The product is flexible in a direction along the plurality of ridges and grooves allowing the product to be stocked in roll form. The moisture drainage product is placed exterior of the sheathing with the ridges and grooves being oriented in a generally vertical direction with the sheet of water permeable material facing the exterior. An exterior veneer is placed exterior of the moisture drainage product.

In a preferred embodiment, the plurality of ridges and grooves are parallel.

In a preferred embodiment, the corrugated material is a material selected from the group consisting of foils, such as copper, stainless steel and aluminum, plastics, and cellulose materials with a moisture resistant additive.

In a preferred embodiment, the corrugated material is a material selected from the group consisting of cementuous and cementuous materials having a reinforced scrim.

In a preferred embodiment, the plurality of ridges and grooves in the sheet of corrugated material are evenly spaced.

In a preferred embodiment, the sheet of water permeable material comprises polypropylene.

In a preferred embodiment, the polypropylene is a spunbond polypropylene.

In a preferred embodiment, the sheet of water permeable material comprises a fabric.

In another alternative embodiment, the present invention provides a method of providing drainage of moisture from a wall of a structure, the wall having structural members and an exterior veneer. A moisture drainage product is applied to the exterior of the structural members. The moisture drainage product has a sheet of corrugated material forming a plurality of ridges and grooves on opposite sides of the sheet of corrugated material. The sheet of corrugated material is relatively inflexible under a force applied generally perpendicular to the sheet. The sheet of corrugated material has a multiplicity of perforations. A sheet of water permeable material is affixed to one side of the sheet of corrugated material. The product is flexible in a direction along the plurality of ridges and grooves allowing the product to be stocked in roll form. The applying a moisture drainage product step is accomplished with the ridges and grooves of the sheet of corrugated material being oriented in a generally vertical direction with the sheet of water permeable material facing away from the structural members. A veneer exterior is applied exterior of the moisture drainage product.

In a preferred embodiment, the veneer exterior is applied exterior to the moisture drainage product with the ridges and grooves of the sheet of corrugated material maintaining an ability to channel to channel moisture along the ridges and grooves.

DETAILED DESCRIPTION

Figure 1:
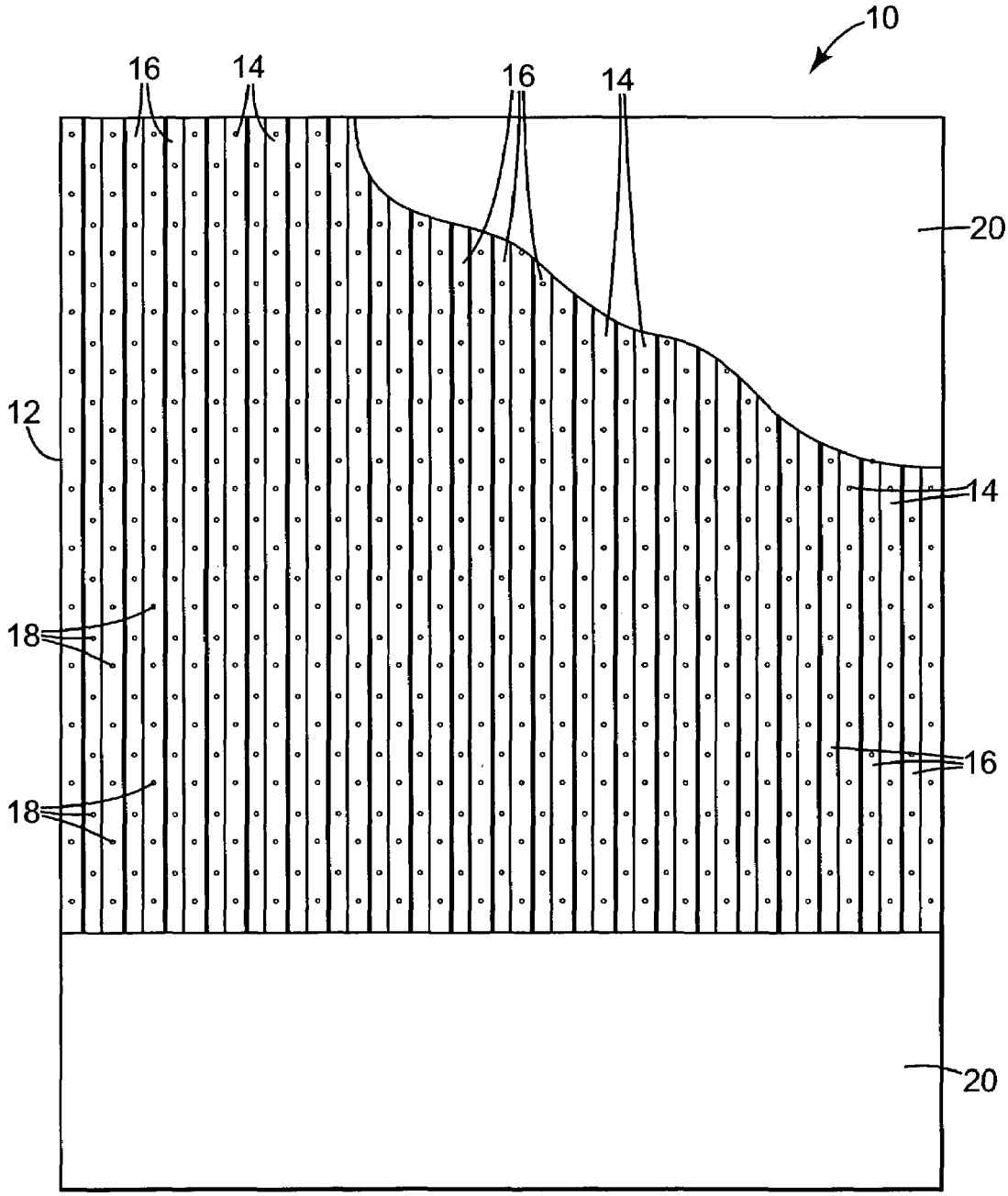
FIG. 1 is a plan view of a moisture drainage product constructed in accordance with an embodiment of the present invention.
Figure 2:
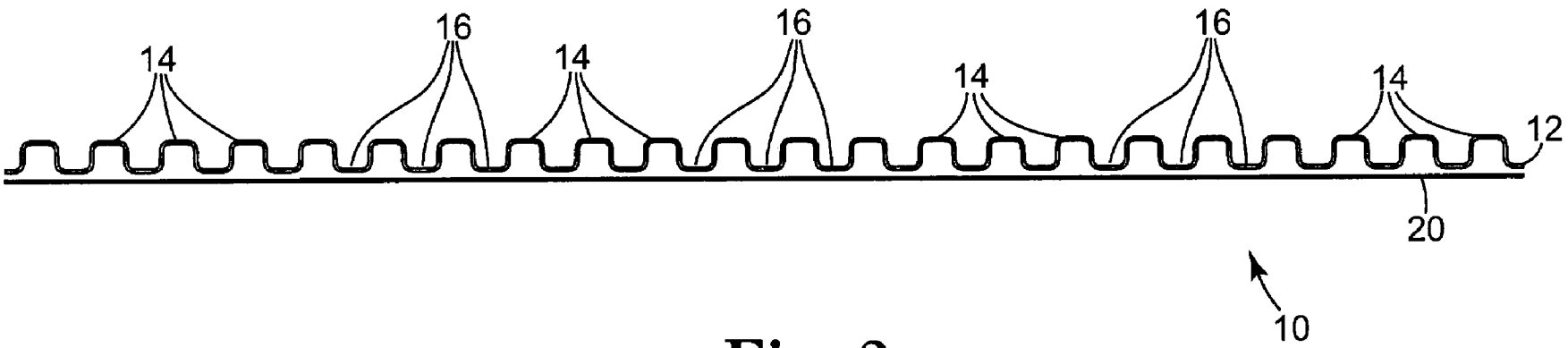
FIG. 2 is a edge view of the moisture drainage product illustrated in FIG. 1.

Since the presence of moisture in wall structures of buildings is not uncommon, it is desirable to drain such moisture from the wall structure. FIG. 1 and FIG. 2 illustrate a section of moisture drainage product 10 constructed in accordance with an embodiment of the present invention. A sheet of corrugated material 12 is formed from a sheet of plastic material which has been heated and passed through a crimping apparatus producing a series of linear ridges 14 and grooves 16 approximately 3/16 of an inch (0.48 centimeters) deep and approximately 7/16 of an inch (1.11 centimeters) on center.

In other embodiments, corrugated material 12 may be constructed from foils, such as copper, stainless steel and aluminum, plastics, and cellulose materials with a moisture resistant additive.

As will be discussed with respect to later Figures, linear ridges 14 and grooves 16 of corrugated material 12 form a plurality of channels which, when moisture drainage product 10 is installed in a wall structure with ridges 14 and grooves 16 oriented in a generally vertical orientation, allows moisture which has accumulated in the wall structure to drain, via gravity, from the wall structure.

Corrugated material 12 also has a multiplicity of perforations 18 which may be formed in corrugated material 12 either before crimping or after although, in a preferred embodiment, perforations 18 are formed before crimping.

Perforations 18 in corrugated material 12 allow moisture, including water and water vapor, to pass through perforations 18. Perforations 18 allow water vapor which has not condensed in the wall structure to continue to pass outwardly through the wall structure. Further, perforations 18, since they are water pervious, allow water moisture to pass through corrugated material 12 and be drained from the wall structure with the channels formed by ridges 14 and grooves 16.

A sheet of material 20 is affixed to one side of corrugated material 12. As shown in FIG. 1 and FIG. 2, sheet of material is affixed to the back side of corrugated material 12. The primary function of sheet of material 20 is to prevent building materials from accumulating in ridges 14 or grooves 16 on the side of corrugated material 12 having sheet of material 20. If building materials, in the course of construction, were allowed to accumulate in such ridges 14 and grooves 16, the channels formed by ridges 14 and grooves 16 could be obstructed by the building material and the drainage ability of the channels formed by ridges 14 and grooves 16 could obfuscated. Sheet of material 20 is also pervious to moisture, including water and water vapor.

In a preferred embodiment, sheet of material 20 is constructed of polypropylene, preferably spunbond polypropylene. Alternatively, sheet of material could be constructed of a fabric woven of a moisture resistant material.

Sheet of material 20 may be affixed to corrugated material 12 in any suitable manner such as by commonly available commercial construction adhesives.

Figure 3:
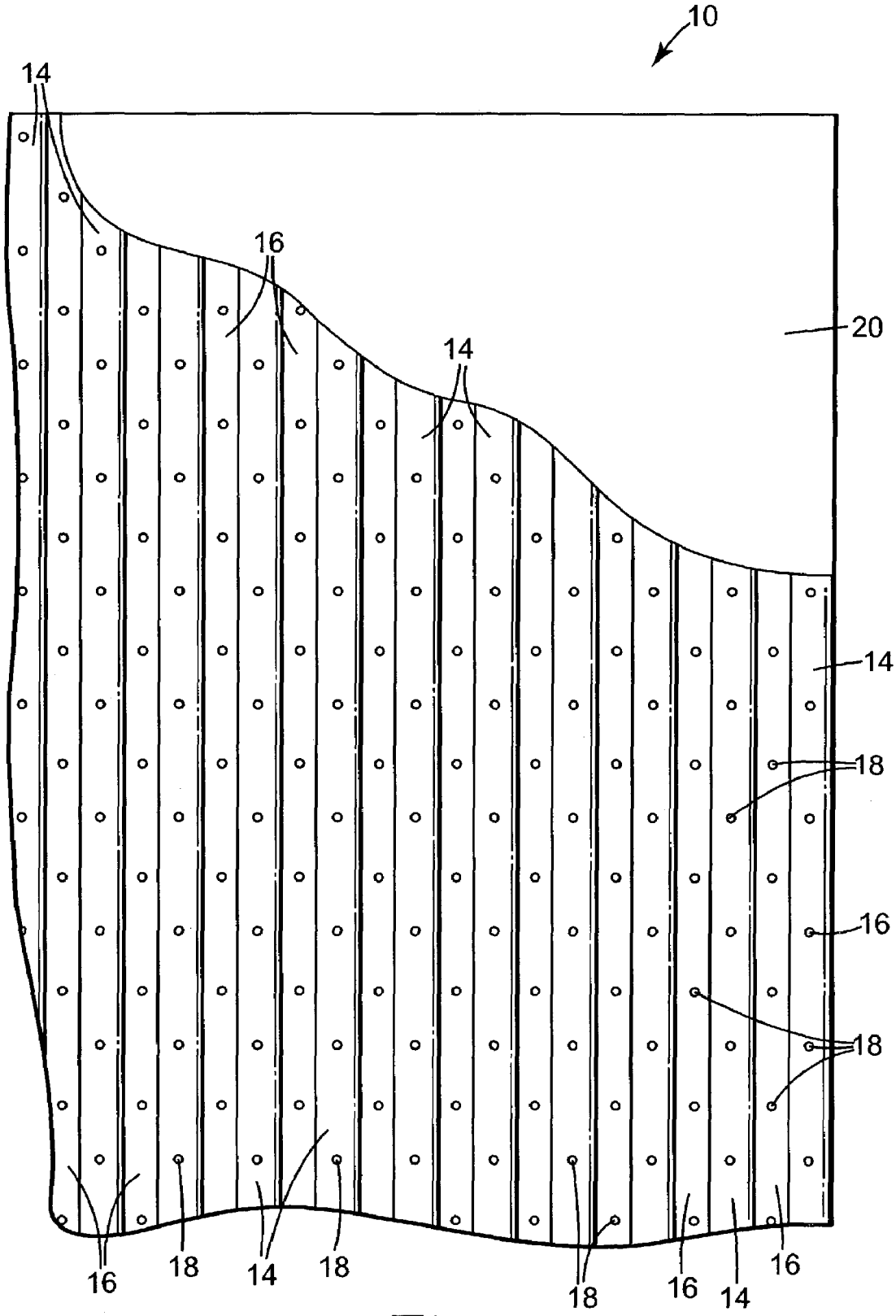
FIG. 3 is a close-up view a portion of the moisture drainage product illustrated in FIG. 1.

FIG. 3 is a close-up view of a portion of moisture drainage product 10 showing corrugated material 12 including ridges 14 and grooves 16 forming channels, perforations 18 and sheet of material 20.

Corrugated material 12 is constructed of a material which is rigid enough such that, when corrugated with ridges 14 and grooves 16, is able to withstand commonly encountered construction forces as moisture drainage material 10 is being installed in a wall structure. Examples of commonly encountered construction forces are hammer or automated nailing strikes either affixing moisture drainage product 10 in the wall structure or affixing a later applied material in the wall structure such as the exterior veneer. As an example, an exterior veneer of stucco typically requires a lathe material to be applied exterior to moisture drainage product 10. The force required by nails or spikes to secure the lathe material to the wall structure should not compromise ridges 14 and grooves 16 to the extent that drainage channels formed by ridges 14 and grooves 16 are obstructed. Similarly, commonly encountered forces involved in shipping, storing and handling of moisture drainage product 10 should also not compromise the drainage channels. In a preferred embodiment, moisture drainage product 10 is able to withstand the weight of a typical construction worker wearing shoes.

It will be appreciated that ridges 14 and grooves 16 of moisture drainage product 10 increase the rigidity of moisture drainage product as moisture drainage product 10 is attempted to be bent transverse to ridges 14 and grooves 16. Thus, ridges 14 and grooves 16 actually increase the rigidity of moisture drainage product 10 and help allow moisture drainage product 10 to withstand normal construction forces. It will also be appreciated that ridges 14 and grooves 16 in moisture drainage product 10 allow moisture drainage product 10 to be less rigid in a direction parallel to ridges 14 and grooves 16. This relatively less rigidity allows moisture drainage product 10 to be shipped, stocked and stored as a roll stock. Preferably, moisture drainage product 10 can be shipped and stored on 50 foot (15.2 meter) rolls. Alternatively, moisture drainage product could also be shipped, stocked and stored as rigid sheet stock.

Figure 4:
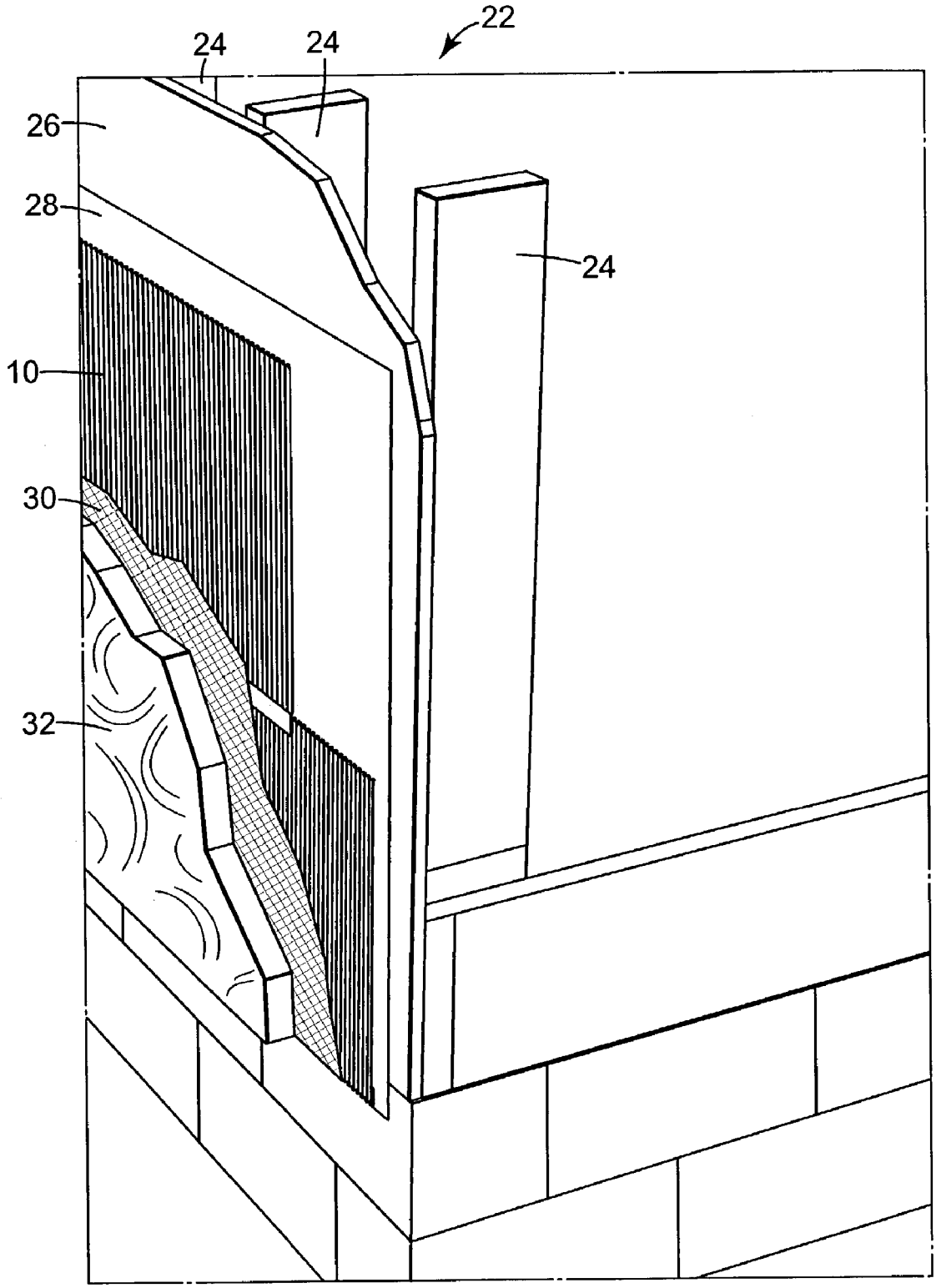
FIG. 4 is a partial cut-away perspective view of a wall structure incorporating the moisture drainage product illustrated in FIG. 1.

FIG. 4 is an illustration of wall structure 22 containing moisture drainage product 10. Starting at the interior side of wall structure 22, conventional studs 24 form a plane along which sheathing 26 may be affixed. Typically, and optionally, a water barrier 28, such as #15 roll stock, is applied exterior to sheathing 26. Moisture drainage product 10 is affixed exterior to water barrier 28 with sheet of material 20 facing outwardly. Sheet of material 20 extends beyond corrugated material 12 on one edge of the roll of moisture drainage product 10. This edge of sheet of material 20 is used to overlap the next roll of moisture drainage product 10. The lowest roll of moisture drainage product 10 in wall structure 22 has this edge of sheet of material 20 wrapped under corrugated material 12 to form a bug screen. A veneer for wall structure 22 is applied exterior to moisture drainage product 10. In one embodiment, the veneer consists of a metal lathe 30 and stucco 32 applied over metal lathe 30. It is to be recognized and understood that many other forms of exterior veneer are also contemplated including, but not limited to concrete block, brick, natural or man-made stone, and wood siding of all types including wooden lap siding.

It can be recognized that without moisture drainage product 10 in wall structure 22 that moisture occurring or accumulating in wall structure 22 can drain through channels created by ridges 14 and grooves 16 in moisture drainage product. Perforations 18 allow moisture drainage product 10 to be water pervious allowing water and water vapor to pass through moisture drainage product 10. This prevents moisture drainage product from a vapor barrier in the middle of wall construction 22 and actually causing the moisture accumulation it is designed to ameliorate. Further, sheet of material 20 prevents the stucco material 32 from obscuring channels formed in corrugated material 12 on the exterior side of moisture drainage product 10.

Figure 5:
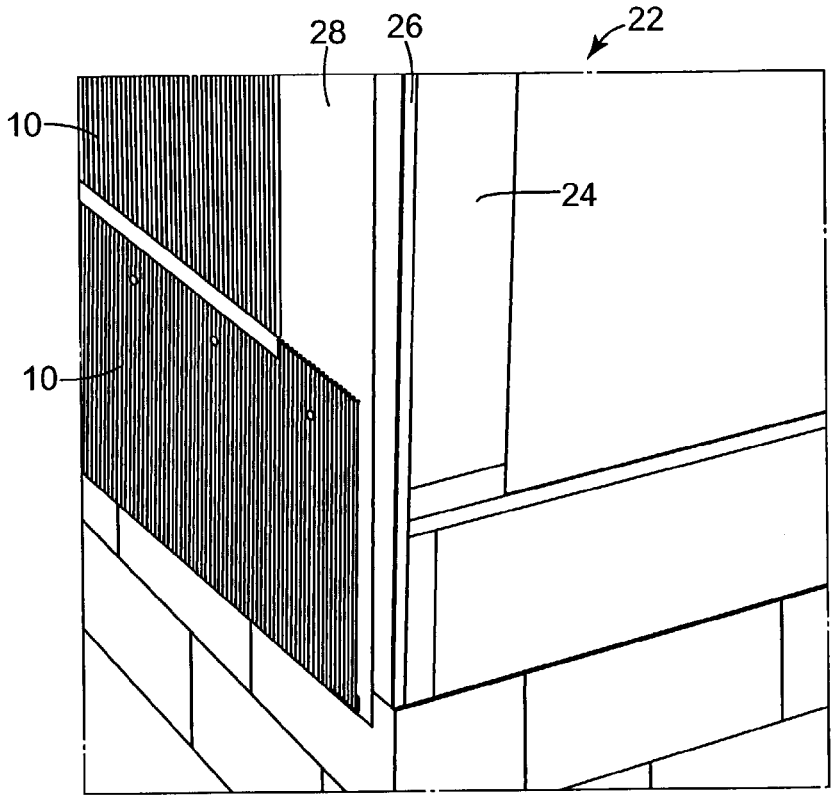
FIG. 5 is a perspective view showing the partial installation of the moisture drainage product illustrated in FIG. 1 installed over sheathing in a wall structure.
Figure 6:
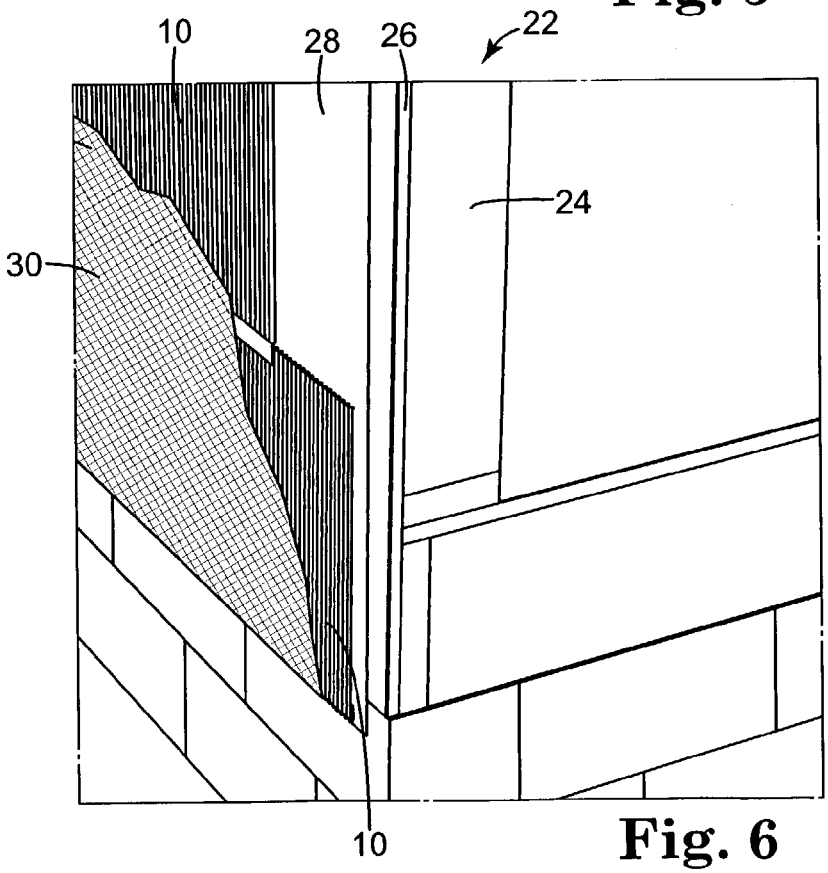
FIG. 6 is a perspective view showing the partial installation of the moisture drainage product illustrated in FIG. 1 in a wall structure with lathe installed over the moisture drainage product.
Figure 7:
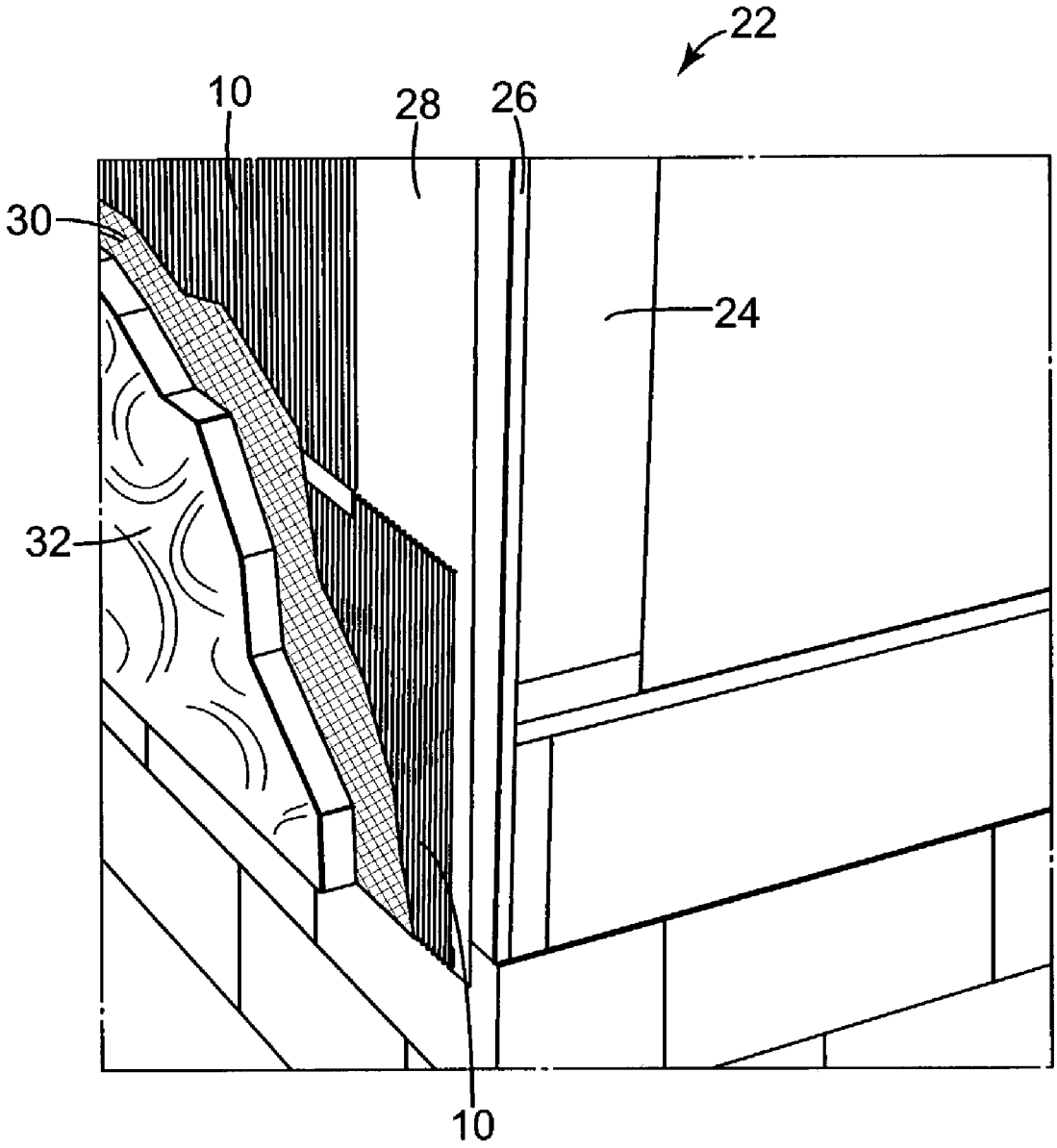
FIG. 7 is a perspective view showing the partial installation of the moisture drainage product illustrated in FIG. 1 in a wall structure with stucco installed over the lather and the moisture drainage product.

FIG. 5, FIG. 6 and FIG. 7 illustrate a method of constructing wall structure 22.

In FIG. 5, wall structure 22 is partially formed with studs 24, sheathing 26 and roll stock 28. This is a typical and conventional wall structure construction technique. Typically, studs 24 are installed and then sheathing 26 is affixed to the exterior side of studs 24. Roll stock 28 is then affixed to the exterior side of sheathing 26. Studs 24, sheathing 26 and, optionally, roll stock 28 form the structural components of wall structure 22. Of course, it is recognized and understood that wooden studs 24, sheathing 26 and roll stock 28 are just one example of what could comprise the structural components of wall structure 22. Many other conventional, and unconventional, products, materials and construction could also used. As can be seen in FIG. 5, moisture drainage product 10 is then conventionally affixed with construction fasteners exterior to roll stock 28 and sheathing 26. Note that sheet of material 20 is again placed on the exterior side of moisture drainage product 10. Thus, FIG. 5 shows wall structure 22 in a partially completed state with moisture drainage product 10 installed but without an exterior veneer.

In FIG. 6, the construction of wall structure 22 has taken one more step, the step of partially completing the exterior veneer. In this embodiment, the exterior veneer is stucco. In order to prepare wall structure 22 for stucco material 32, lathe, preferably metal lathe, 30 is conventionally affixed exterior of moisture drainage product 10. In FIG. 7, stucco 32 can be seen having been applied to lathe 30. Again, especially since stucco material 32 is semi-liquid when applied to lathe 30 and is intermixed with lathe 30 to give stucco structural integrity, that it is likely that stucco 32 would get into the channels formed by ridges 14 and grooves 16 of corrugated material 12 if it were not for sheet of material 20 which effectively prevents the clogging of the channels formed by ridges 14 and grooves 16.

Various modifications and alterations of this invention will be apparent to those skilled in the art without departing from the scope and spirit of this invention. It should be understood that this invention is not limited to the illustrative embodiments set forth above.

What is claimed is:

1. A product adapted to allow drainage of moisture from a wall of a structure, comprising:

a sheet of corrugated material forming a plurality of ridges and grooves on opposite sides of said sheet of corrugated material, said sheet of corrugated material being relatively inflexible under a force applied generally perpendicular to said sheet, said sheet of corrugated material having a multiplicity of perforations; and a sheet of material affixed to one side of said sheet of corrugated material, said sheet of material being water permeable;

said product being flexible in a direction along said plurality of ridges and grooves allowing said product to be stocked in roll form;

wherein said sheet of material affixed to one side of said sheet of corrugated material extends beyond said sheet of corrugated material a distance allowing said sheet of material to be wrapped under an edge of said ridges and grooves.

2. A wall system for a structure having an interior and an exterior, comprising:

a plurality of structural members forming a structural support for said wall system;

sheathing placed exterior of said plurality of structural members;

a moisture drainage product adapted to allow drainage of moisture from said wall system, comprising:

a sheet of corrugated material forming a plurality of ridges and grooves on opposite sides of said sheet of corrugated material, said sheet of corrugated material being relatively inflexible under a force applied generally perpendicular to said sheet, said sheet of corrugated material having a multiplicity of perforations; and a sheet of material affixed to one side of said sheet of corrugated material, said sheet of material being water permeable;

wherein said sheet of material affixed to one side of said sheet of corrugated material extends beyond said sheet of corrugated material a distance, said sheet of material being wrapped under an edge of said ridges and grooves;

said product being flexible in a direction along said plurality of ridges and grooves allowing said product to be stocked in roll form;

said moisture drainage product being placed exterior of said sheathing with said ridges and grooves being oriented in a generally vertical direction with said sheet of water permeable material facing said exterior; and an exterior veneer placed exterior of said moisture drainage product.

3. A wall system as in claim 2 wherein said sheet of material is wrapped under an edge of said ridges and grooves at a bottom of said wall system.

4. A product adapted to allow drainage of moisture from a wall of a structure, comprising:

a sheet of corrugated material forming a plurality of parallel ridges and grooves approximately 3/16 of an inches (0.48 centimeters) deep and approximately 7/16 of an inch (1.11 centimeters) on center on opposite sides of said sheet of corrugated material, said sheet of corrugated material being relatively inflexible under a force applied generally perpendicular to said sheet, said sheet of corrugated material having a multiplicity of perforations; and a sheet of material affixed to one side of said sheet of corrugated material, said sheet of material being water permeable;

said product being flexible in a direction along said plurality of ridges and grooves allowing said product to be stocked in roll form;

wherein said sheet of material affixed to one side of said sheet of corrugated material extends beyond said sheet of corrugated material a distance allowing said sheet of material to be wrapped under an edge of said ridges and grooves.

5. A product as in claim 4 wherein said plurality of ridges and grooves are oriented vertically.

6. A product as in claim 4 wherein said plurality of ridges and grooves in said sheet of corrugated material are evenly spaced.

7. A wall system for a structure having an interior and an exterior, comprising:

a plurality of structural members forming a structural support for said wall system;

sheathing placed exterior of said plurality of structural members;

a moisture drainage product adapted to allow drainage of moisture from said wall system, comprising:

a sheet of corrugated material forming a plurality of ridges and grooves approximately 3/16 of an inches (0.48 centimeters) deep and approximately 7/16 of an inch (1.11 centimeters) on center on opposite sides of said sheet of corrugated material said sheet of corrugated material being relatively inflexible under a force applied generally perpendicular to said sheet, said sheet of corrugated material having a multiplicity of perforations; and a sheet of material affixed to one side of said sheet of corrugated material, said sheet of material being water permeable;

said product being flexible in a direction along said plurality of ridges and grooves allowing said product to be stocked in roll form;

said moisture drainage product being placed exterior of said sheathing with said ridges and grooves being oriented in a generally vertical direction with said sheet of water permeable material facing said exterior; and an exterior veneer placed exterior of said moisture drainage product;

wherein said sheet of material affixed to one side of said sheet of corrugated material extends beyond said sheet of corrugated material a distance, said sheet of material being wrapped under an edge of said ridges and grooves.

8. A wall system as in claim 7 wherein said sheet of material is wrapped under an edge of said ridges and grooves at a bottom of said wall system.

* * * * *

UNITED STATES PATENT AND TRADEMARK OFFICE

CERTIFICATE OF CORRECTION

PATENT NO. : 6,990,775 B2
APPLICATION NO. : 10/464063
DATED : January 31, 2006
INVENTOR(S) : Koester It is certified that error appears in the above-identified patent and that said Letters Patent is hereby corrected as shown below:

Column 8, Line 32, insert --,-- after "material"

Signed and Sealed this

Tenth Day of April, 2007

JON W. DUDAS
*Director of the United States Patent and Trademark Office*